US008672273B2

(12) United States Patent
Brown et al.

(10) Patent No.: US 8,672,273 B2
(45) Date of Patent: Mar. 18, 2014

(54) RAIL CAR SENSOR NETWORK

(75) Inventors: Richard H. Brown, Otis Orchards, WA (US); John Z. Dorn, Erwinna, PA (US); Jeffery G. Elliott, Danbury, CT (US); Paul A. Moskowitz, Yorktown Heights, NY (US); Jonathan M. Reason, Port Chester, NY (US); Xianjin Zhu, Stony Brook, NY (US)

(73) Assignee: International Business Machines Corporation, Armonk, NY (US)

( * ) Notice: Subject to any disclaimer, the term of this patent is extended or adjusted under 35 U.S.C. 154(b) by 1308 days.

(21) Appl. No.: 11/971,263

(22) Filed: Jan. 9, 2008

(65) Prior Publication Data

US 2009/0173840 A1 Jul. 9, 2009

(51) Int. Cl.
*B61K 1/00* (2006.01)

(52) U.S. Cl.
USPC ..... 246/169 R; 246/169 A

(58) Field of Classification Search
USPC ..... 246/122 R, 169 R, 169 A, 169 D, 169 S
See application file for complete search history.

(56) References Cited

U.S. PATENT DOCUMENTS

| | | | | |
|---|---|---|---|---|
| 4,781,119 | A * | 11/1988 | Davis | 104/93 |
| 5,735,492 | A * | 4/1998 | Pace | 246/125 |
| 6,104,978 | A * | 8/2000 | Harrison et al. | 701/207 |
| 6,860,453 | B2 * | 3/2005 | Moretti et al. | 246/169 R |
| 6,925,366 | B2 * | 8/2005 | Theurer et al. | 701/19 |
| 6,985,803 | B2 * | 1/2006 | Abdel-Malek et al. | 701/33 |
| 7,213,789 | B1 * | 5/2007 | Matzan | 246/169 S |
| 7,239,238 | B2 * | 7/2007 | Tester et al. | 340/539.31 |
| 2006/0261218 | A1 * | 11/2006 | Mace et al. | 246/169 R |
| 2007/0046220 | A1 | 3/2007 | Alton et al. | |
| 2007/0078574 | A1 | 4/2007 | Davenport | |
| 2007/0152107 | A1 * | 7/2007 | LeFebvre et al. | 246/169 R |
| 2009/0173840 | A1 * | 7/2009 | Brown et al. | 246/1 R |

* cited by examiner

*Primary Examiner* — Jason C Smith
(74) *Attorney, Agent, or Firm* — Cantor Colburn LLP; Preston Young

(57) ABSTRACT

A rail car sensor network, in accordance with an exemplary embodiment of the present invention, includes at least one rail car having a main body portion including a first and section, a second end section and an intermediate portion. The rail car network further includes a sensor assembly mounted to the rail car. The sensor assembly includes at least one sensor positioned to detect a rail car parameter, and a wireless communication device configured to transmit data corresponding to the rail car parameter. A receiver assembly, mounted remote from the at least one rail car, includes a wireless communication monitor configured to receive the data corresponding to the rail car parameter from the wireless communication device.

12 Claims, 3 Drawing Sheets

RAIL CAR SENSOR NETWORK

BACKGROUND OF THE INVENTION

1. Field of the Invention

This invention relates to the art of rail car systems and, more particularly, to a rail car sensor network.

2. Description of Background

Everyday, in almost every country, thousands of rail cars travel overland delivering passengers and goods. Typically, the rail cars travel as part of a rail car system or train. A typical train includes one or more engines that pull (or push) the rail cars to a particular destination. The location, speed and itinerary of each train are monitored by sensing a position of the engine. The position of the engine is determined through track based sensors or via Global Positioning System (GPS) tracking. Unfortunately, position information does not provide more detailed data concerning the individual rail cars.

At present, visual inspection is the method employed to determine a particular orientation of a rail car, a location/position of a particular rail car in a rail car system or train, whether a rail car is, or is not, part of a particular train, or a general condition of a rail car. Orientation and position information is important from a load perspective. Determining a particular orientation and/or relative location of a rail car enables transportation personnel to accurately determine various factors regarding train movement. Likewise, determining whether a particular rail car is, or is not, part of a train allows transportation personnel to accurately deliver and track goods in transit. Monitoring a general condition of a rail car, for example, bearing temperature, enables transportation personnel to monitor the effectiveness of maintenance cycles and proactively make any required repairs before damage results. Moreover, monitoring rail cars parked on a siding requires personal inspection. That is, the location of the rail car is located in a log, or operators of trains passing parked rail cars pass on the cars location to yard personnel. Visually monitoring for the above factors is labor intensive, time consuming and subject to various inaccuracies.

SUMMARY OF THE INVENTION

The shortcomings of the prior art are overcome and additional advantages are provided through the provision of a rail car sensor network constructed in accordance with an exemplary embodiment of the present invention. The rail car sensor network includes at least one rail car having a main body portion including a first end section, a second end section and an intermediate portion. The rail car network further includes a sensor assembly mounted to the rail car. The sensor assembly includes at least one sensor positioned to detect a rail car parameter, and a wireless communication device configured to transmit data corresponding to the rail car parameter. A receiver assembly, mounted remote from the at least one rail car, includes a wireless communication monitor configured to receive the data corresponding to the rail car parameter from the wireless communication device.

In accordance with another exemplary embodiment of the present invention, a method of networking, a rail car provided with a sensor assembly having at least one sensor and a wireless communication device includes sensing a parameter of rail car to obtain rail car parameter data and, transmitting the rail car parameter data to a remote wireless receiver.

Additional features and advantages are realized through the techniques of exemplary embodiments of the present invention. Other embodiments and aspects of the invention are described in detail herein and are considered a part of the claimed invention. For a better understanding of the invention with advantages and features thereof, refer to the description and to the drawings.

BRIEF DESCRIPTION OF THE DRAWINGS

The subject matter which is regarded as the invention is particularly pointed out and distinctly claimed in the claims listed at the conclusion of the specification. The foregoing and other objects, features, and advantages of the invention are apparent from the following detailed description taken in conjunction with the accompanying drawings in which:

The detailed description explains the exemplary embodiments of the invention, together with advantages and features thereof, by way of example with reference to the drawings.

DETAILED DESCRIPTION OF THE INVENTION

Figure 1:
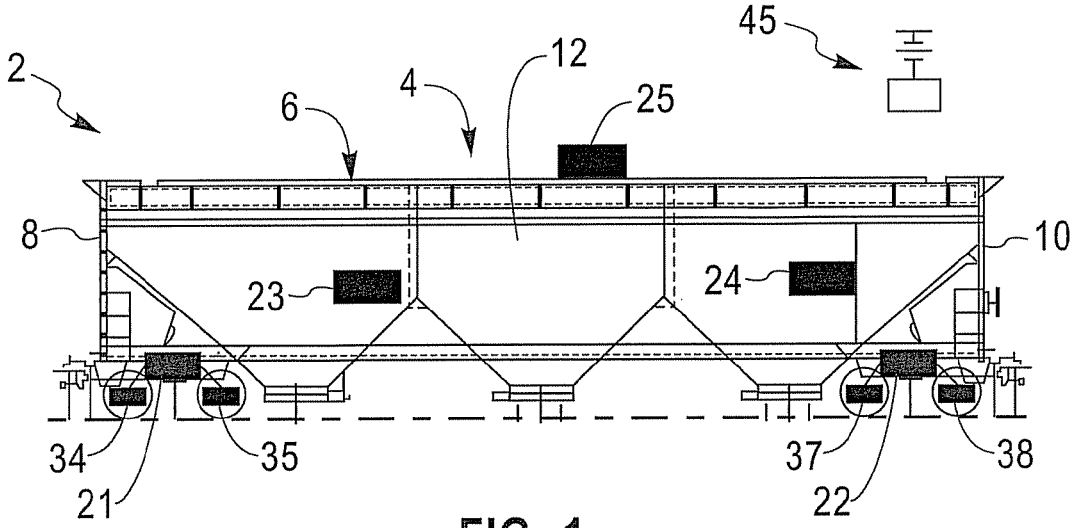
FIG. 1 illustrates a rail car including a rail car network having multiple rail car sensor assemblies in accordance with an exemplary embodiment of the present invention.

With initial reference to FIG. 1 a rail car sensor network, constructed in accordance with an exemplary embodiment of the present invention, is generally indicated at 2. Rail car sensor network 2 includes a rail car 4 having a main body portion 6 including a first end section 8, a second end section 10, and an intermediate section 12. Rail car 4 is provided with a plurality of motes or sensor assemblies 21-25 that are configured to detect various parameters associated with rail car 4. Examples of various configurations for sensor assemblies 21-25 include temperature sensing devices for sensing internal and external temperatures of rail car 4, location sensing devices using, for example, GPS signals to determine a location of rail car 4 geographically and signal strength sensors to determine the position of rail car 4 relative to other rail cars (not shown), direction of travel sensors, distance traveled sensors as well as vibration sensors. In addition to internal sensors that will be detailed more fully below, sensor assemblies 21-25 could also include external sensors, such as sensors 34 and 35 shown associated with sensor assembly 21, and sensors 37 and 38 shown connected to sensor assembly 22. In the exemplary embodiment shown, sensors 34, 35 and 37, 38 are configured to detect bearing temperature for each wheel (not separately labeled) of rail car 4. As will be discussed more fully below, each sensor assembly 21-25 is configured to communicate with others of sensor assemblies 21-25, as well as additional sensor assemblies (not shown) and/or a wireless receiver 45.

Figure 2:
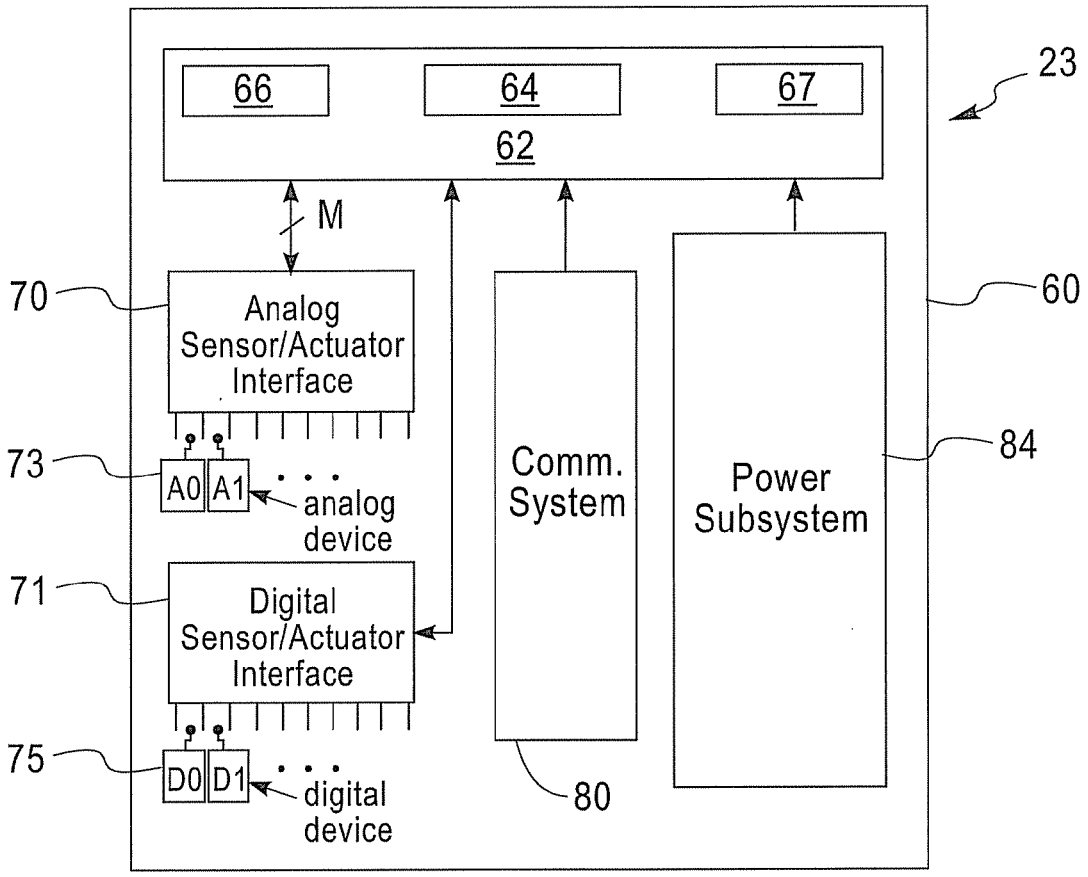
FIG. 2 illustrates a rail car sensor assembly constructed in accordance with an exemplary embodiment of the present invention.
Figure 3:
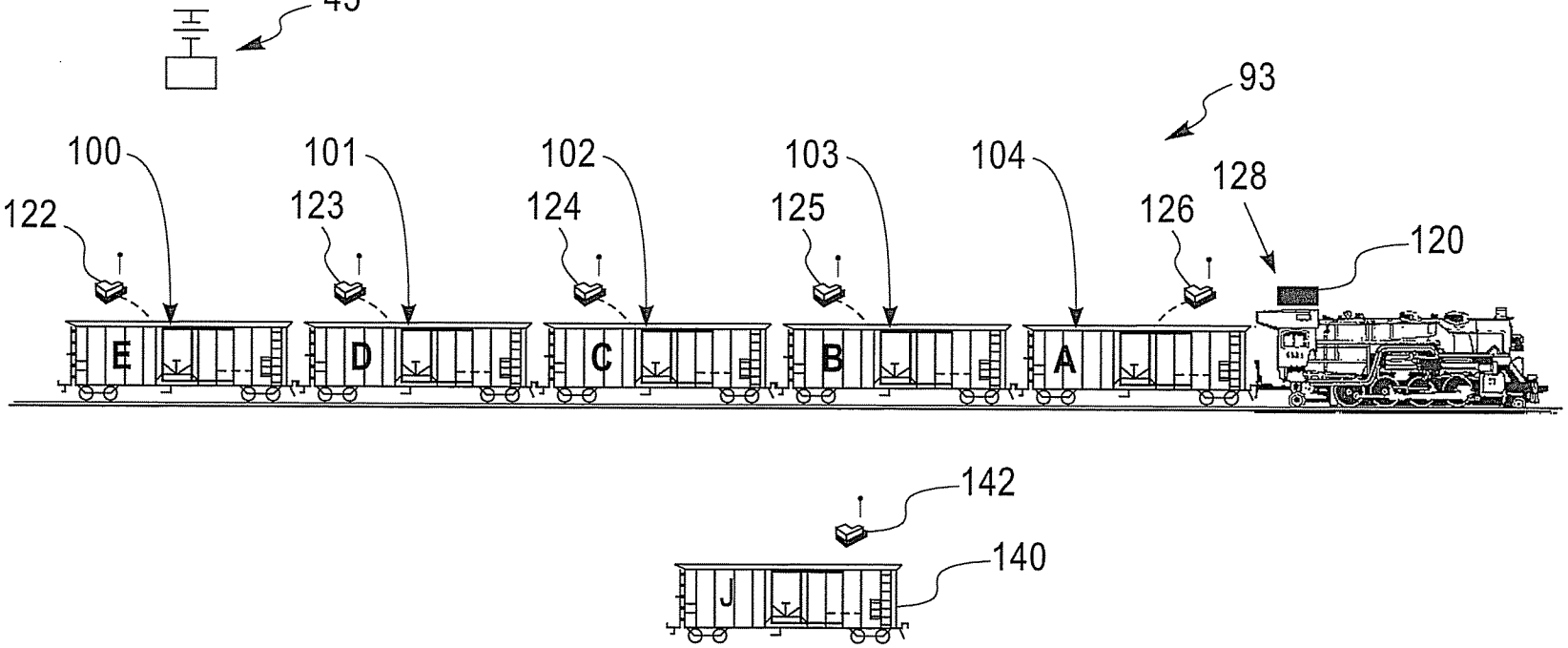
FIG. 3 illustrates a rail car sensor network in accordance with an exemplary embodiment of the present invention.

Reference will now be made to FIG. 2 in describing sensor assembly 23 with an understanding that sensor assemblies 21, 22 and 24, 25 are similarly constructed. However, it should also be understood that sensor assemblies 21-25 can vary internally depending upon the particular configuration necessary to detect a particular rail car parameter. In any event, sensor assembly 23 is shown to include a housing 60 within which is arranged a central bus 62. Central bus 62 includes a central processing unit or CPU 64 as well as a plurality of integral sensors indicated generally at 66 and 67. Integral sensors 66 and 67 can take on a variety of forms such as accelerometers, temperature sensors, GPS sensors and the like. Sensor assembly 23 is also shown to include a pair of sensor interface members 70 and 71. Each sensor interface member 70 and 71 serves as an interface for external and/or internal sensor devices such as indicated in 73 and 75. In accordance with one aspect of the invention, sensor interface 70 is an analog sensor/actuator interface, while sensor interface 71 is a digital sensor/actuator interface. Of course, it should be understood, that sensor interfaces 70, 71 can both be analog or both be digital depending on the particular requirements for sensor assembly 23.

Sensor assembly 23 is further shown to include a communication system 80 that is designed to transmit rail car parameter data collected by sensor assembly 23 to receiver 45, and a power system 84 that provides power for the various components of the sensor assembly 23. Power system 84, in accordance with one aspect of the present invention, includes one of a solar cell, a chemical cell and a pneumatic power cell. That is, power system 84 is designed so as to be self-contained, requiring little if any maintenance in order to provide a long service life for sensor assembly 23. Alternatively, power system 84 is configured as a hybrid storage device including multiple distinct power storage devices such as, for example, a supercap, a lithium-ion battery and/or a long life battery. In any event, sensor assembly 23 is configured to communicate with receiver 45 and/or other sensor assemblies 21, 22, 24 and 25 in rail car sensor network 2 as well as sensor assemblies (not shown) that are external to rail car sensor network 2 as will be discussed more fully below.

In accordance with another aspect of the invention, rail car sensor network 2 is incorporated into a rail car system 93 having a plurality of rail cars 100-104 and a lead car or driving unit/engine 106. Each rail car 100-104 includes an associated sensor assembly 122-126 while driving unit 106 is provided with a gateway member 120. In this configuration, each sensor assembly 122-126 communicates with others of sensor assemblies 122-126 and gateway member 120. Gateway member 120 collects rail car parameter data passed through sensor assemblies 122-126 as well as data stored in memory (not shown). More specifically, upon coming into proximity with receiver 45, gateway member 120 selectively uploads rail car parameter data to receiver 45.

In accordance with another aspect of the invention, gateway member 120 gathers information from the plurality of sensor assemblies 122-126 and calculates a total order of railcars. Position and/or orientation is determined by sensing a delay time or signal strength of wireless radio communications received from sensor assemblies 122-126. The orientation of a rail car may mean a facing direction, e.g., which end of the rail car is closest to lead car 106 in rail car system 93. Of course it should be understood that while lead car 106 is described as the engine, other rail cars in rail car system 93 can be so designated. In addition, to a facing direction of the rail car relative to lead car 106, sensor assembly 122-126 determining a position, e.g., the location in the order or sequence of two or more rail cars that make up rail car system 93 of the associated rail car in rail car system 93. The total order is computed by applying a collection of rules to relative signal strengths determined by each sensor assembly 122-126 relative to others of sensor assemblies 122-126. Each rule determines a numerical evidence for railcar side adjacency. The numerical evidence from all rules is mathematically combined using an evidence combination algorithm. Finally, the total order is calculated by starting with a selected end car and building a total sequence by iteratively selecting a most likely unsequenced railcar adjacency for a railcar most recently added to the sequence. This total order is communicated to sensor assemblies 122-126. In this manner, each sensor assembly 122-126 determines associated railcar position in the overall sensor network to optimize power communications.

Figure 4:
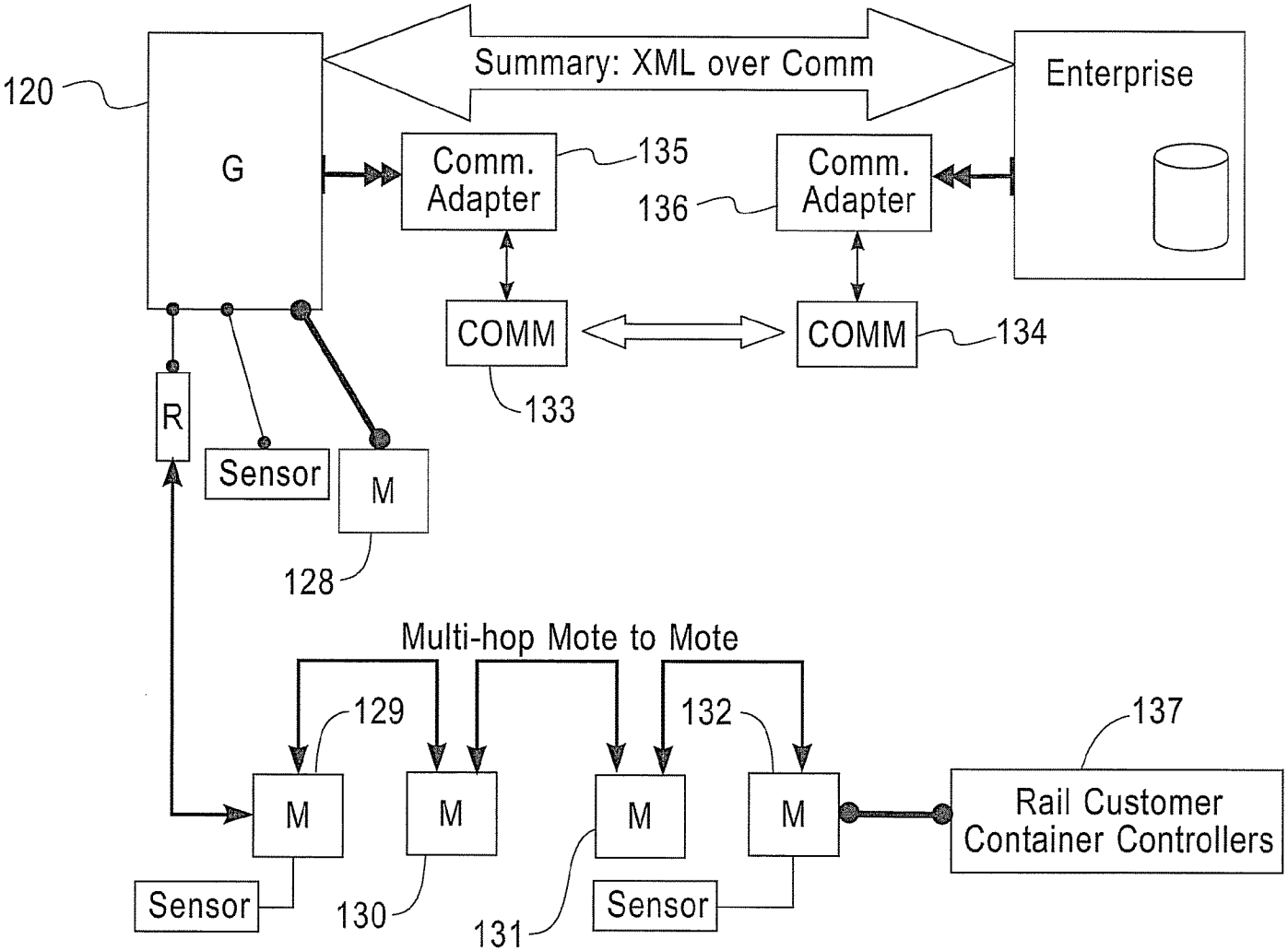
FIG. 4 illustrates a system architecture in accordance with an exemplary embodiment of the present invention.

With reference to FIG. 4, gateway member 120 is linked to a plurality of sensor arrays 128-132. Gateway member 120 is responsible for bidirectional communication of both sensor information and detected normal and anomalous conditions with rail car sensor network 2 using any of a number of available wide area communications mechanisms such as communication or COMM transceivers 133 and 134, each of which employs an associated "native communications protocol. Gateway member 120 employs a plurality of communication adapters two of which are indicated at 135 and 136. Gateway 120 selects a particular one of communication adapters 135 and 135 based on criteria including: whether communications can be established; priority of the communications; and a figure of merit assigned to the communication adapter 135 and 135. In accordance with an exemplary embodiment of the invention, gateway member 120 employs a common open formatting mechanism "XML" to encode sensor information and detected conditions. Gateway member 120 can also interpret sensor information from rail customer container controllers, such as indicated at 137, that interface with sensor arrays 129-132 as described above. Gateway member 120 detects normal and anomalous conditions of rail customer container controllers in a manner similar to that used for conditions in each rail car, and communicates the detects conditions in a manner similar to that described above.

In the above-described configuration, an operator sitting at receiver 45 can query gateway device 120 to determine the particular location of each rail car 100-104 within rail car system 93 as well as various parameters associated with each rail car 100-104. That is, sensor assemblies 122-126 communicate one with the other, with a signal strength received from each sensor assembly determining a particular position of the associated rail car 100-104 in the rail car system 93. In addition, rail car sensor network 2 can be employed to determine the particular orientation of each rail car 100-104 within rail car system 93 by determining the position of each sensor assembly 122-126 relative to others of sensor assemblies 122-126. Of course, additional sensors or sensor assemblies could also be employed to detect the orientation of the rail cars as well as other rail car parameter data.

In accordance with another aspect of the present invention, gateway device 120 is configured to communicate with rail cars unassociated with rail car system 93. More specifically, a rail car, such as indicated generally at 140, sitting on a siding includes a sensor assembly 142 that is configured to communicate rail car parameter data to gateway 120. That is, as driving unit 120 passes the unassociated rail car 140 sitting on the siding, sensor assembly 142 detects gateway device 120 and automatically uploads rail car data such as, rail car identification, rail car contents, rail car location and the like. Upon reaching a particular destination or, coming into proximity with receiver 45, gateway device 120 upload the information regarding rail car 142. More specifically, each sensor assembly is configured in a particular mode of operation with each rail car being designated as one of an unassociated rail car, a yard associated rail car, an associated disconnected rail car, and an associated connected rail car. In addition to associated disconnected and associated connected rail cars, each rail can be configured as a transitive associated disconnected rail car or a transitive associated connected rail car.

A rail car not associated with any rail car system or yard network, and not synchronized to any gateway device is designated as an unassociated rail car. That is, for example, rail car 140 sitting on siding is designated as an unassociated rail car. Conversely, rail cars can be designated as yard associated when associated with a particular location in a rail yard. Yard associated rail cars are configured to communicate with a yard gateway enabling operator personnel to locate a particular rail car in the yard and connect the particular rail car to a rail car system. Associated disconnected rail cars are associated with a particular rail car system and are controlled by an on board gateway device, such as gateway device 120. The disconnected designation represents that the gateway device has not yet provided any upstream communications. That is, sensor assemblies provided in an associated disconnected rail car have not yet uploaded rail car parameter data through the gateway device 120 to receiver 45. Conversely, a car designated as an associated connected rail car includes at least one sensor assembly that is in direct communication with gateway device 120 and, which has already provided upstream communication through gateway device 120 to receiver 45.

Transitive associated disconnected rail cars include at least one sensor assembly that communicates to gateway device 120 through neighboring sensor assemblies. The disconnected designation indicates that the at least one sensor assembly has not yet been identified or confirmed by gateway device 120. More specifically, rail cars designated as transitive associated disconnected include sensor assemblies configured to communicate with other sensor assemblies and not directly with gateway device 120 or with remote receiver 45. In this mode, rail car parameter data is passed from one sensor assembly to another sensor assembly prior to being routed through gateway device 120 to remote receiver 45. Conversely, a transitive associated connected rail car includes sensor assemblies that have been identified by a gateway device, have communicated rail car parameter data to other sensor assemblies and had the rail car data pass to receiver 45.

At this point, it should be appreciated that the rail car network described above provides a robust, flexible rail car monitoring system that allows supervising personnel to determine location, speed, direction, configuration and various other rail car parameter data of a rail car system. In addition to monitoring active rail cars, the rail car sensor network provides operators with a device for monitoring stationary or inactive rail cars such as those sitting in a rail car yard or those sitting on a siding remote from a rail yard. In this manner, all rail cars can be accounted for, destination information determined, rail car health monitored, and rail cars sitting remote from a yard can be detected and, brought into a rail car system as needed.

The capabilities of the present invention can be implemented in software, firmware, hardware or some combination thereof. While the preferred exemplary embodiments to the invention have been described, it will be understood that those skilled in the art, both now and in the future, may make various improvements and enhancements which fall within the scope of the claims which follow. These claims should be construed to maintain the proper protection for the invention first described.

The invention claimed is:

1. A rail car sensor network comprising:

at least one rail car including a main body portion having a first end section, a second end section and an intermediate portion;

a sensor assembly mounted to the rail car, the sensor assembly including at least one sensor positioned to detect a rail car parameter, and a wireless communication device configured to transmit data corresponding to the rail car parameter, the at least one sensor including at least one orientation sensor configured to detect an orientation of the at least one rail car relative to another rail car; and a receiver assembly mounted remote from the at least one rail car, the receiver assembly including a wireless communication monitor configured to receive the data corresponding to the rail car parameter from the wireless communication device, wherein the at least one rail car is a plurality of rail cars that establish a rail car system, each of the plurality of rail cars includes a corresponding sensor assembly, the wireless communication device in each of the plurality of rail cars being configured to transmit rail car parameter data to the wireless communication device arranged in others of the plurality of rail cars and the receiver assembly.

2. The rail car sensor network according to claim 1, further comprising: a gateway device mounted to one of the plurality of rail cars, the gateway device relaying rail car parameter data from the sensor assembly in each of the plurality of rail cars to the receiver assembly.

3. The rail car sensor network according to claim 1, wherein the sensor assembly includes a plurality of sensors positioned to detect multiple rail car parameters.

4. The rail car sensor network according to claim 3, wherein rail car system includes a lead car, wherein the at least one orientation sensor is configured to detect the a position of at least one of the plurality of rail cars in the rail car system relative to the lead car.

5. The rail car sensor network according to claim 4, wherein the orientation sensor detects at least one of a facing direction of the rail car with respect to the lead car in the rail car system.

6. The rail car sensor network according to claim 3, wherein the plurality of sensors includes a wheel bearing sensor.

7. The rail car sensor network according to claim 1, wherein the sensor assembly includes at least one analog sensor interface and at least one digital sensor interface.

8. The rail car sensor network according to claim 1, wherein the sensor assembly includes a power system.

9. The rail car sensor network according to claim 8, wherein the power system is a self-contained power supply including one of a solar power cell, a chemical power cell, and a pneumatic power cell.

10. The rail car sensor network according to claim 8, wherein the power system is a hybrid storage device including multiple distinct power storage devices.

11. The rail car sensor network according to claim 9, wherein the multiple distinct power storage devices include at least one of a super cap, a lithium ion battery, and a long-life battery.

12. A rail car sensor network comprising:

at least one rail car including a main body portion having a first end section, a second end section and an intermediate portion;

a sensor assembly including a power system mounted to the rail car, the sensor assembly including at least one sensor positioned to detect a rail car parameter, and a wireless communication device configured to transmit data corresponding to the rail car parameter, the at least one sensor including at least one orientation sensor configured to detect an orientation of the at least one rail car relative to another rail car, wherein the power system is a hybrid storage device including multiple distinct power storage devices; and a receiver assembly mounted remote from the at least one rail car, the receiver assembly including a wireless communication monitor configured to receive the data corresponding to the rail car parameter from the wireless communication device.

* * * * *